US006484455B1

(12) United States Patent
Poole

(10) Patent No.: US 6,484,455 B1
(45) Date of Patent: Nov. 26, 2002

(54) RIGID WINDOW WELL STRUCTURE

(76) Inventor: Scot Poole, 578 S. Blossom Cir., Fruit Heights, UT (US) 84037

( * ) Notice: Subject to any disclaimer, the term of this patent is extended or adjusted under 35 U.S.C. 154(b) by 0 days.

(21) Appl. No.: 09/515,547

(22) Filed: Feb. 29, 2000

(51) Int. Cl.[7] ..... E06B 5/02

(52) U.S. Cl. ..... 52/107; 52/19; 52/169.7; 405/284

(58) Field of Search ..... 52/19, 107, 169.6, 52/169.7, 309.15; 405/284

(56) References Cited

U.S. PATENT DOCUMENTS

| | | | | |
|---|---|---|---|---|
| 300,654 | A | | 6/1884 | Smith |
| 3,004,634 | A | * | 10/1961 | Evans et al. ..... 52/107 |
| 3,999,334 | A | | 12/1976 | Webb |
| D248,071 | S | | 6/1978 | Simmons |
| 4,704,828 | A | | 11/1987 | Kemp |
| 4,876,833 | A | | 10/1989 | Gefroh et al. |
| 4,896,467 | A | | 1/1990 | McGinnis |
| 5,107,640 | A | | 4/1992 | Gefroh et al. |
| 5,881,503 | A | | 3/1999 | Eichelberger |

* cited by examiner

*Primary Examiner*—Robert Canfield
*Assistant Examiner*—Brian E. Glessner
(74) *Attorney, Agent, or Firm*—Thorpe North & Western, LLP

(57) ABSTRACT

A rigid window well structure having first and second planar side walls and a planar front wall; first and second connecting walls, where the first connecting wall joins the first side wall to the front wall, and the second connecting wall joins the second side wall to the front wall, such that each of the walls expose an interior surface and an exterior surface; and a step bridged between the interior surface of at least two non-parallel walls, at least one of the two non-parallel walls being planar.

31 Claims, 3 Drawing Sheets

RIGID WINDOW WELL STRUCTURE

FIELD OF THE INVENTION

The present invention relates to building component products. More specifically, the invention relates to structures configured for forming window wells and improvements therein, with a view to providing such components that are highly rigid, functional and aesthetically pleasing.

BACKGROUND OF THE INVENTION

For many years sub-terrain window systems have been designed to allow light into basement areas in order to make the space more desirable, as well as meet building code requirements, as discussed below. These window systems generally comprise a standard size or other window located, at least in part, below grade. Provided at the window location is a window well structure surrounding the outside window surface which acts, at least in part, to retain the earth. An early effort to accomplish this is shown in U.S. Pat. No. 300,654 entitled "Area Window Protector" first patented in 1884. Since then, many other areaway or window well designs and improvements have been patented directed to the improvement of window well structure capabilities such as admitting light and retaining earth.

Due to a desire to utilize basement windows for a possible escape route during emergencies, and later due to many building codes provisions regarding basement egress, window wells or areaways have been designed to facilitate such an escape in case of an emergency. For example, U.S. Pat. No. 3,999,334, issued in 1976, describes an areaway that is an extension of the basement space beyond the foundation wall. This patent disclosure recognizes that a basement window could be useful as a means of escape.

More recently, relatively deep window well structures having U-shaped cross-sections and a vertical wall on each of three sides have been developed. It has been recognized as desirable to provide a series of steps or a ladder therein so that an escapee may more easily scale the wall of the window well structure. This has traditionally been accomplished by the use of an separate external ladder that drops into the window well.

Alternatively, and as taught in U.S. Pat. No. 4,876,833, structure allowing for an escape system and also enabling utilization of the space created by the structure for aesthetic purposes is possible. One embodiment disclosed comprises a window well structure or areaway system where the walls are not vertical, but are configured like a stairway.

Other designs for window wells have previously been disclosed, such as those found in U.S. Pat. No. 4,896,467; U.S. Pat. No. D248,071; U.S. Pat. No. 5,107,640; and U.S. Pat. No. 4,704,828.

The foregoing references and discussion illustrate that window well structures have functioned to: a) provide an escape route in an emergency, b) provide light to a basement area; and c) to retain the earth. Recognition of the importance of providing an aesthetically pleasing window well structure has also evolved. A decorative window well structure is described in U.S. Pat. No. 5,881,503. That reference discloses a window well structure, preferably comprised of a high-strength plastic material, having planter boxes on the interior vertical walls which double as escape steps. Additionally, the reference teaches that the plastic material may be fabricated to have an aesthetically pleasing appearance, such as by incorporating a brick or granite "look" in surface texture and configuration.

Structural integrity has also been an important part of window well structure design. For this reason, window well structures have typically been corrugated to provide rigidity. Additionally, prior to the present invention, window well structures having a U-shaped cross section have been the design of choice of most manufacturers. This is likely due to the fact that most window well structures are formed of metal. The U-shape cross section is a convenient and low-cost shape to manufacture in metal, and U-shaped window well structures are relatively strong due simply to inherent advantages of the geometry.

SUMMARY OF THE INVENTION

It has been recognized that a drawback of using metal in window well structures is that it is heavier and more difficult to shape in a specific one piece configuration than a high density polymeric resin material or a combination of high density/low density polymeric resins. For example, it would be much more difficult to provide a single-piece window well structure having "built in" steps in a metal material than it would be with a polymeric resin material. Additionally, a plastic is a good material to use if the desire is to fabricate window well structures that are aesthetically pleasing, e.g., color and texture are easily modified. However, since plastic is often flexible, it is important to provide a design that is rigid, particularly when the window well is deep and is being used as an emergency escape.

As such, the present invention provides an improved window well structure over those previously disclosed. Whether the chosen material from which the structure is formed is a polymeric resin, filled or otherwise a composite material or not, or whether the window well structure is corrugated or not, window well structures in accordance with principles of the present invention are highly rigid, functional and aesthetically pleasing. Such a structure includes a rigid window well structure having a front wall, two side walls, two connecting walls, an interior surface, an exterior surface, and at least one integral step built-in or afterward attachable, adjacent to the interior surface and disposed between the front wall and one of the side walls, and configured to facilitate escape in the event of an emergency. In a more detailed aspect, the configuration can have increased rigidity due to the presence of one or more steps, either formed as a single continuous piece or as a modular assembly. Such an escape step formed in a window well structure can be very rigid due to both design and location within the window well.

In a further more detailed aspect, each step defines a cavity on the exterior surface of a window well panel structure such that the retained earth acts with the panel to form a composite structure configured to further support the step and rigidify the entire window well structure.

In a further more detailed aspect, a window well structure in accordance with principles of the invention is configured to provide a new window well design that is rigid and aesthetically pleasing, even without the presence of escape steps. More specifically, such a rigid window well structure in accordance with principles of the invention comprises a) a first planar side wall, b) a second planar side wall, c) a planar front wall, d) a first connecting wall, e) a second connecting wall, wherein the first connecting wall joins the first side wall to the front wall and the second connecting wall joins the second side wall to the front wall, such that each of the walls expose an interior surface and an exterior surface and f) a step bridged between the interior surfaces of at least two walls. In a more detailed aspect, the step can bridge the interior surface of the front wall and the interior surface of the first side wall.

In a further detailed aspect, a rigid window well structure in accordance with the invention can comprise a) a first planar side wall, b) a second planar side wall, c) a planar front wall, d) a first planar connecting wall and e) a second planar connecting wall, wherein the first connecting wall joins the first side wall to the front wall and the second connecting wall adjoins the second side wall to the front wall, and wherein the connecting walls are each configured to be disposed at an angle of about 120–150° in relation to the interior surface of the front wall and about 60–120° in relation to the opposing connecting wall.

Further features and advantages of the invention will become apparent from the following detailed description, taken in conjunction with the accompanying drawings, which illustrate, by way of example, the features of the invention.

BRIEF DESCRIPTION OF THE DRAWINGS

In the accompanying drawings which illustrate embodiments of the invention.

DETAILED DESCRIPTION OF THE INVENTION

Before the present invention is disclosed and described, it is to be understood that this invention is not limited to the particular configurations, process steps and materials disclosed herein as these may vary to some degree. It is also to be understood that the terminology used herein is used for the purpose of describing particular embodiments only, and is not intended to be limiting as the scope of the present invention. The invention will be limited only by the appended claims and equivalents thereof.

It must be noted that, as used in this specification and the appended claims, singular forms of "a," "an," and "the" include plural referents unless the content clearly dictates otherwise.

Figure 1:
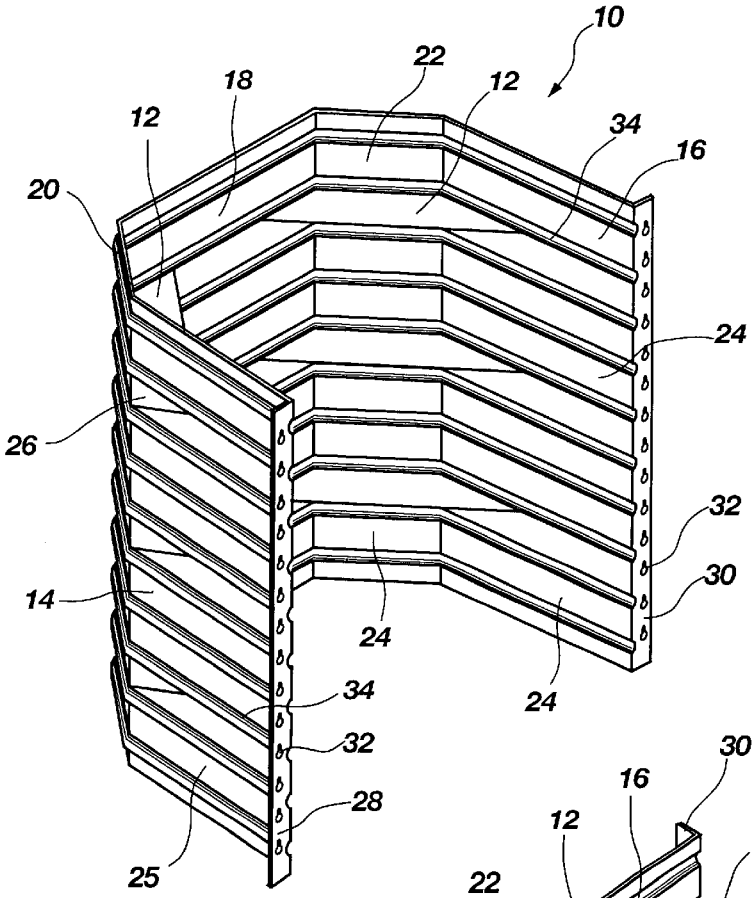
FIG. 1 is a perspective view illustrating an interior portion of a corrugated window well structure having built-in escape steps in accordance with principles of the invention.
Figure 2:
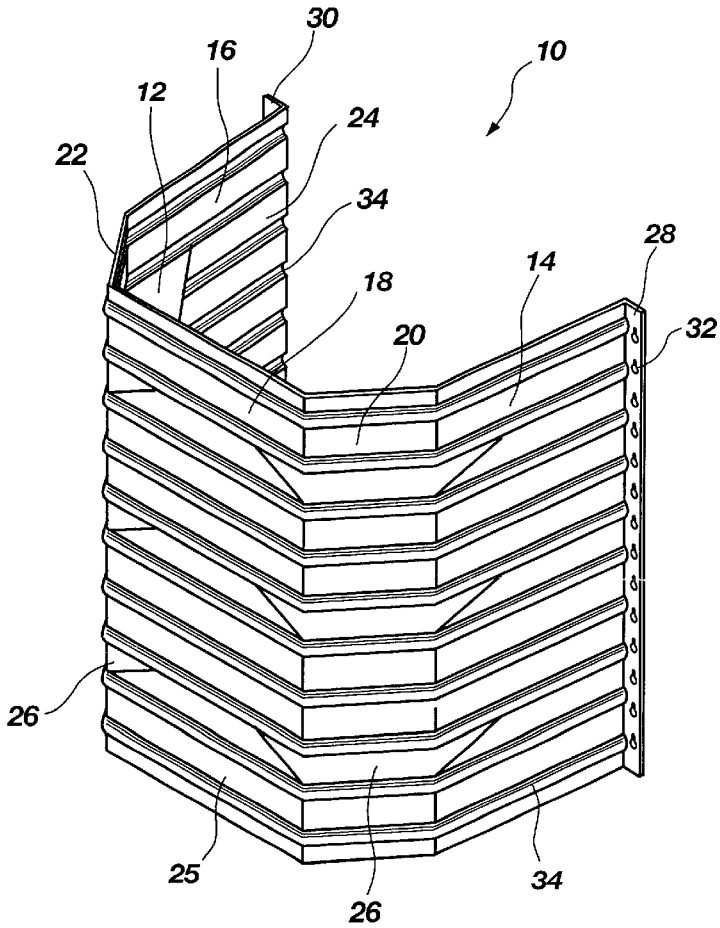
FIG. 2 is a perspective view illustrating an exterior portion of the structure of FIG. 1.

Referring to FIG. 1 and FIG. 2, a window well structure 10 having built-in steps 12 is shown. The steps can be formed as a unitary part of the structure, or can be integral but separable attachable members. The steps facilitate egress in the event of necessity, such as escape from a fire. The window well structure 10 in one embodiment is comprised of a first generally planar vertical side wall 14 and a second generally planar vertical side wall 16 which are essentially parallel to one another when attached to an exterior wall or foundation of a home or other building (not shown). A generally planar vertical front wall 18 is also provided and is oriented essentially perpendicular to the side walls 14, 16. In this embodiment, the front wall 18 and the side walls 14, 16 are configured rectangularly and have similar height dimensions. A first vertical connecting wall 20 and a second connecting wall 22 (also configured rectangularly) join the front wall 18 and the side walls 14, 16 respectively. In other words, the first connecting wall 20 joins the first side wall 14 to the front wall 18 and the second connecting wall 22 joins the second side wall 16 to the front wall 18. In the illustrated embodiment, all the above vertical walls are oriented vertically, but it will be understood that the invention is not so limited, and that orientations other than vertical are possible.

As the walls 14, 16, 18, 20, 22 are joined or continuously formed in the manner shown, an interior surface 24 is created. The connecting walls 20, 22 are each oriented at about 135° with respect to the interior surface 24 of the front wall 18 in the exemplary embodiment, but other angles can be used. Angles in the range of about 120–150° are currently preferred. Similarly, the connecting walls 20, 22 are each configured at about 135° with respect to the interior surface 24 of the side wall 14, 16, though angles in a range of about 120–150° are preferred. Though the side walls 14, 16 are not directly connected to the front wall 18, the angle relationship between a side wall 14, 16 and the front wall 18 is about 90° in the present embodiment, though again other angles are possible, and as an example, those in the range of about 60–120° are currently preferred.

The steps 12 mentioned are formed on the inner surface 24 of the window well structure 10, enabling utilization of the window well as a means for escape in an emergency. The currently preferred composition of the window well structure is a high density polymeric resin or a combination of high density/low density polymeric resins, the window well structure will preferably be molded to form a single and continuous piece comprising a structural panel having a thickness ranging from about ¼ to ¾ inches. As such, the steps 12 form step cavities 26 in the outside surface of the structure. The step cavities 26 are disposed across the connecting walls 20, 22 and the steps are further supported by a portion of the side walls 14, 16 and the front wall 18. This design adds rigidity to the steps and to the structure as a whole.

Additionally, particulate material or earth (not shown), which the window well structure 10 is designed to retain, fills the step cavities 26. This forms a composite structure of earth and window well structural panel, adding additional strength to the already rigid steps 12 and the overall structure.

The window well structure 10 is fastened to a foundation (not shown) by fasteners or flanges comprising a first fastening strip 28 and a second fastening strip 30, connected to the side walls 14, 16 respectively. A plurality of fastening holes 32 are provided in the fastening strips so that fasteners (not shown) can be used to attach the window well structure 10 to the foundation or window buck (not shown). The fastening strips flange outwardly in the illustrated embodiment, but could alternatively project forwardly if desired.

In the embodiment shown, the window well structure 10 has a corrugated configuration comprising folds or ridges 34 incorporated therein to add to the overall rigidity of the window well structure 10. Other techniques and structures configured to add rigidity are also contemplated and will be apparent to those skilled in the art. Examples include diamond patterned, hexagon patterned, etc., criss-cross ribs and/or indentations. Alternatively, due to the additional strength of the window well structure 10 added by the steps 12, corrugated ridges and the like can be omitted in some cases, giving the window well structure a more smooth look.

Figure 3:
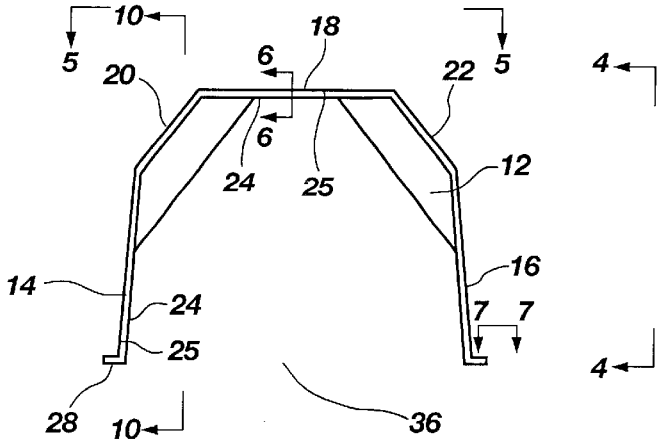
FIG. 3 is an overhead or plan view of the structure shown in FIG. 1.
Figure 4:
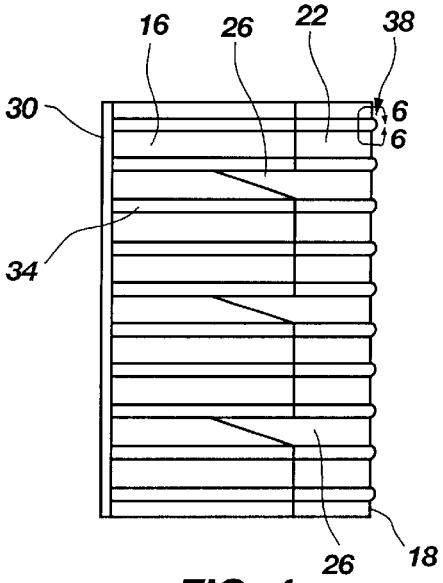
FIG. 4 is a side elevation view, taken along line 4—4 in FIG. 3, of an exterior side of the window well structure shown in FIG. 3.
Figure 5:
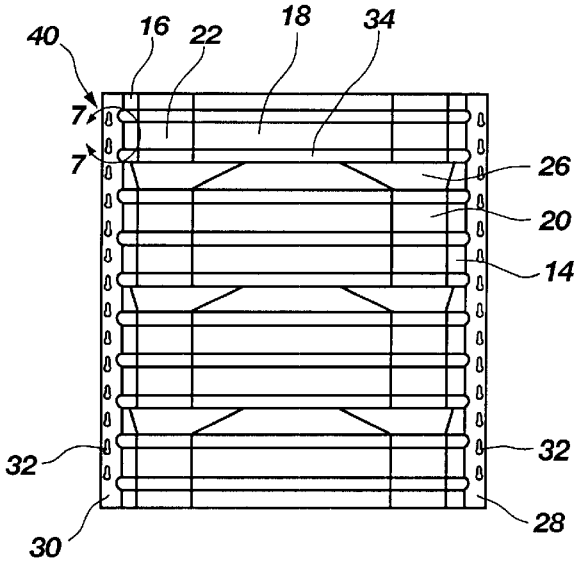
FIG. 5 is an elevation view, taking along line 5—5 in FIG. 3, of the exterior front of the window well structure of FIG. 3.
Figure 6:
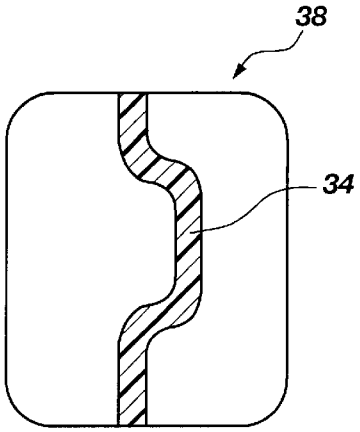
FIG. 6 is a cross-sectional view, taken along lines 6—6 in FIGS. 3 and 4, of a portion of the structure shown in those FIGS.
Figure 7:
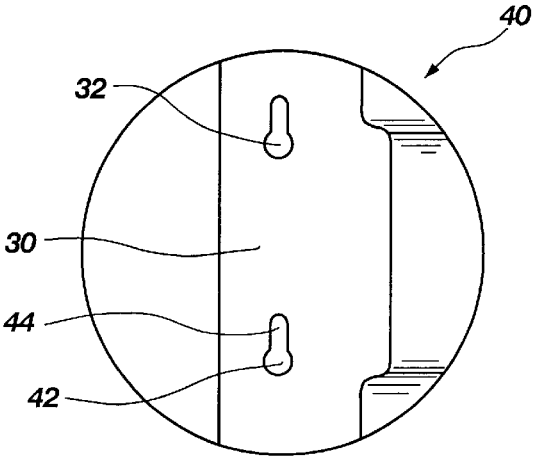
FIG. 7 is a detail view, taken along lines 7—7 in FIGS. 3 and 4, of a portion of the structure shown in those FIGS.

Referring now to FIG. 3, a window well structure 10 having built-in escape steps 12 is shown in a view that more clearly depicts a presently preferred angle relationship between the side walls 14, 16, the front wall 18 and the connecting walls 20, 22. The steps join and run parallel to the connecting walls and bridge the side walls to the front wall, adding rigidity to the structure.

The first planar side wall 14 and the second planar side wall 16 are shown to be essentially parallel to one another. With reference to this top-down perspective, it will be appreciated that essentially parallel is not intended to necessarily mean precisely parallel. For example, if the window well structure 10 is fabricated from a plastic material, a slight spreading of the side walls 14, 16 near the open end 36 will facilitate removal of the window well structure 10 from a mold during fabrication.

If the window well structure 10 is comprised of walls that are relatively short in a height dimension, then steps 12 may not be required. In such an instance, the steps may be removed, leaving the walled structure as shown absent the steps 12.

With reference to FIGS. 4, 5, 6 and 7, the relationship between the side walls 14, 16, the connecting walls 20, 22 and the front wall 18 are shown. Additionally, the relationship between the step cavities 26 and the walls 14, 16, 18, 20, 22 is also shown. The fastening strips 28, 30 have fastening holes 32 formed therein. These are shaped to accept the head of a fastener (not shown) at a circular portion 42 and retain the head of the fastening device (not shown) at an elongated portion 44. For example, the window well structure 10 may be pressed against a foundation (not shown) such that a plurality of fastening devices (not shown) attached to the foundation or window buck are accepted through the circular portions 42 of the fastening holes 32. Then, as the window well structure is slid in a downward direction, the elongated portion 44 of the hole 32 accepts the fastening device and attaches and immobilizes the window well structure 10.

Figure 8:
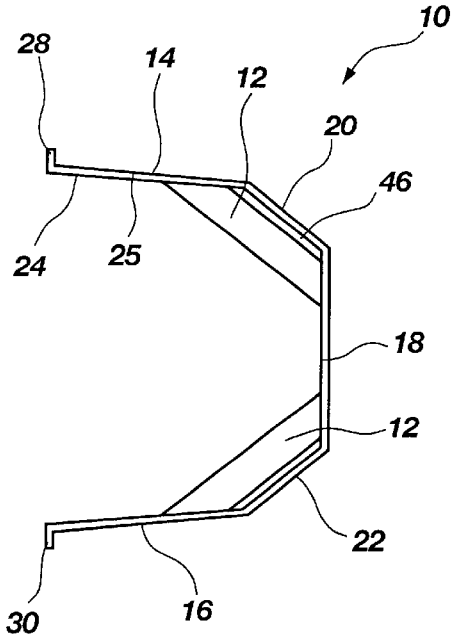
FIG. 8 is a plan or top view of a window well structure in another embodiment in accordance with principles of the invention, having steps connected to the front and side walls, but not joined to the connecting walls.

Referring now to FIG. 8, an embodiment similar to that shown in FIG. 3 is illustrated, except that a gap 46 between the connecting walls 20, 22 and the steps 12 is provided. Though the steps in this embodiment add some strength to the window well structure and also provide a means of escape in case of an emergency, because the steps are configured as webs attached only to the side walls 14, 16 and the front wall 18, and not the connecting walls 20, 22, this window well structure 10 is not as rigid as that illustrated in FIG. 3.

Though it is currently preferred to provide steps 12 which are connected to a side wall 14, a corresponding connecting wall 20 and the front wall 18, in another embodiment, the steps 12 are connected to any two of three contiguous walls, i.e., any two of three selected from the first side wall 14, the first connecting wall 20 and the front wall 18; or two of three selected from the second side wall 16, the second connecting wall 22 and the front wall 18. For example, a single step 12 can bridge the front wall 18 and a first or second connecting wall 20, 22. Alternatively, a single step can bridge a first or second connecting wall 20, 22 to a first or second side wall 14, 16 respectively.

Figure 9:
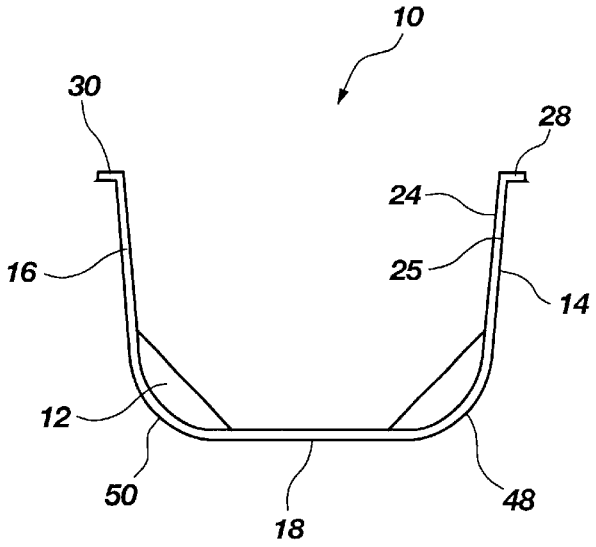
FIG. 9 is a plan or top view of a window well structure in another embodiment in accordance with principles of the invention, having arcuate connecting walls and steps configured along the arcuate walls.

Referring now to FIG. 9, in another embodiment, a window well structure 10 has arcuate connecting walls 48, 50 and steps 12 configured along the arcuate walls. This embodiment is similar to that illustrated in FIG. 3, except that rather than having planar connecting walls (not shown), arcuate connecting walls 48, 50 are provided. Rigidity is increased when the steps 12 span the entire length of the arcuate connecting walls 48 and bridge the side walls 14, 16 to the front wall 18 as has been previously described.

Figure 10:
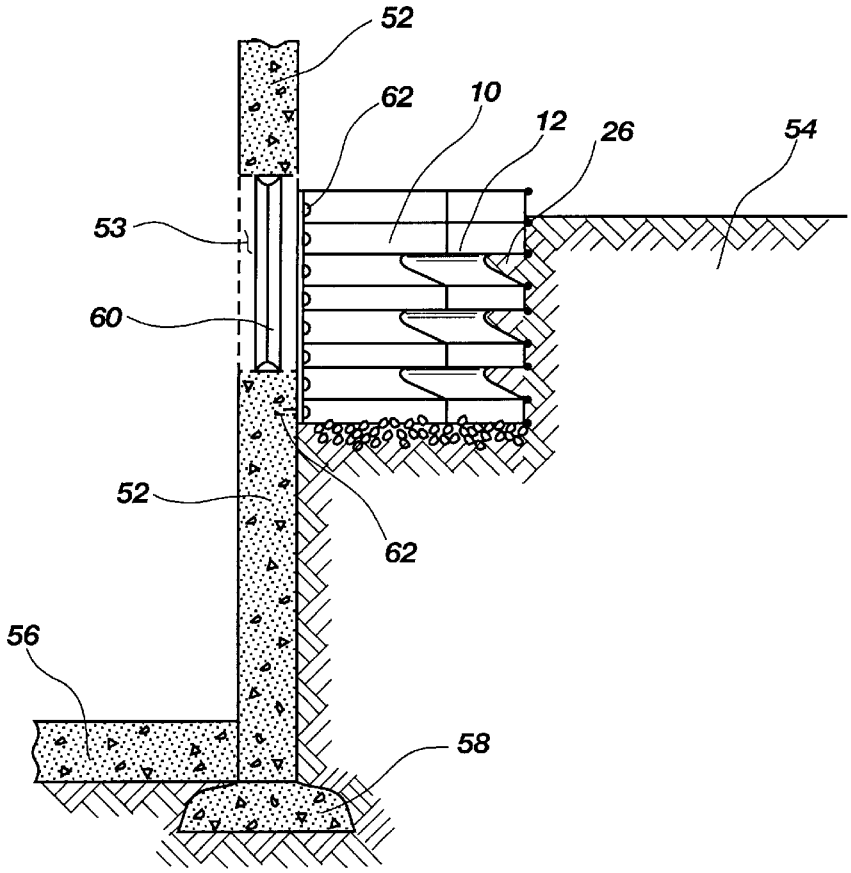
FIG. 10 is a cross-sectional view, taken along line 10—10 in FIG. 3, window well structure in accordance with principles of the present invention attached to a foundation wall.

With reference to FIG. 10, a window well structure 10 in accordance with principles of the present invention is attached to a typical concrete foundation wall 52 or window buck (not shown). The foundation wall 52 or window buck and the window well structure 10 act to retain earth 54 on the exterior of the foundation wall. On the interior of the foundation wall 52, a concrete slab 56 is disposed which acts as the interior floor. The foundation wall is supported by a footing 58. Within a space defined by the foundation wall, is a window 60 protected from the earth 54 by the window well structure 10. The window well structure 10 is fastened to the foundation wall 52 or buck by fasteners 62 of one of the many suitable types known by those skilled in the art and widely commercially available. The step cavities 26 discussed above are in contact with, and back-filled with earth 54, such that the surrounding earth packs the cavities 26, adding additional strength to the steps.

With the above embodiments in mind, a rigid window well structure is disclosed comprising a) a first and a second planar side wall, b) a planar front wall and c) a first and a second connecting wall. The first connecting wall adjoins the first side wall to the front wall and the second connecting wall adjoins the second side wall to the front wall such that each of the walls expose an interior surface and an exterior surface. At least one step is bridged between the interior surfaces of at least two walls, though it is preferred that the step is bridged between the interior surface of the front wall and the interior surface of the first side wall. However, it is even more preferred that the step also be connected to the interior surface of the of the first connecting wall, adding more rigidity to the step. Though this aspect of the invention only requires one step within the window well, a second step is preferably bridged between the interior surface of the front wall and the interior surface of the second side wall. Again, it is preferred that the second step is also connected to the interior surface of the second connecting wall. Depending on the height of the walls, it may be desirable to add additional steps to the interior surface. As such, at least one additional step bridged between the interior surface of the front wall and the interior surface of the first side wall and at least one additional step bridged between the interior surface of the front wall and the interior surface of the second side wall is contemplated. Again, it is preferred that the additional steps are further connected to the interior surface of the connecting walls.

In the preferred embodiment, the rigid window well structure has planar connecting walls forming a window well structure as shown in FIGS. 1 and 2. However, the connecting walls may be arcuate or some other shape as is known in the art. To add additional strength, one or more walls of the window well structure may also be corrugated as is commonly known in the art.

If a window well structure is to be shaped similar to that illustrated in FIGS. 1 and 2, the connecting walls can each be configured so as to be disposed at an angle in the range of about 120–150° in relation to the interior surface of the front wall, and about 60–120° in relation to the opposing connecting wall. However, in the illustrated embodiment the connecting walls can each be configured at about 135° in relation to the interior surface of the front wall and about 90° in relation to the opposing connecting wall.

Though an important feature of the present invention is the presence of built-in escape steps which add to the overall rigidity, a window well structure without escape steps is also possible. Such window well structures are especially useful when the vertical height dimensions of the walls are less than about 44 inches. This window well structure comprises only a first and a second planar side wall, a planar front wall and first and second planar connecting walls. The first connecting wall joins the first side wall to the front wall and the second connecting wall joins the second side wall to the front wall 18. The connecting walls are each configured to be disposed at about 120–150° in relation to the interior surface of the front wall, and at about 60–120° in relation to the opposing connecting wall. Again, the connecting walls in one embodiment are configured at about 135° in relation to the interior surface of the front wall, and at about 90° in relation to the opposing connecting wall. his embodiment is similar to that shown in FIGS. 1 and 2 with the exception that the steps 12 and step cavities 26 are absent.

With any of the embodiments disclosed, rigid material or a combination of materials to form a rigid composite can be used to form the window well structure 10 and/or steps 12 of the present invention. Currently preferred materials are a high density polymeric resin (plastic) and low density plastics capable of foaming in the presence of an additive. Metals can also be used.

It can be desirable to utilize more than one material in the same window well structure, e.g., two types of plastics, a metal and plastic combination, filled plastics, fiberglass and other resin/fiber composites, etc. If a high density plastic material is used, many suitable polymeric resins are known, for example, high density polyalkylenes or combination of polyalkylenes may be used. An exemplary polyalkylene known in the plastics industry is high density polyethylene. A suitable low density plastic to be used in conjunction with a high density shell or skin is linear low density polyethylene that is capable of foaming in the presence of an additive. Plastic window well structures are generally more lightweight than those made from metal. Additionally, window well structures formed from plastics, particularly those having steps formed therein, are more easily produced as a single unitary (continuous) piece.

Specifically, one possible plastic molding process suitable for fabrication of the window well structure 10 is a multilayering process. Multilayered parts can be produced by blow molding, injection molding, rotational molding, and/or other methods of plastic molding. For example, two high density polyethylene (HDPE) skins are formed which define the exterior surface and the interior surface of the window well structure. A narrow gap or space separates the skins such that a linear low-density polyethylene (LLDPE) resin and preferably a foaming agent may be injected between the HDPE skins forming a LLDPE core. A celogen additive is an exemplary foaming agent as it causes the polyethylene of the LLDPE resin to foam appropriately. Once the foam is set, a high density/low density/high density sandwiched wall is formed having increased thickness and stiffness without substantially increasing the weight of the window well structure. This process is one of many that may be utilized to form the rigid window well structures of the present invention. It would be apparent to those skilled in the art that modifications of this process or other plastics fabrication processes may be utilized to form the window well structures of the present invention. Additionally, if the window well structures are formed from a different material, such as a metal, the shaping of the window well structure may be accomplished by commonly used methods known by those skilled in the art.

While the invention has been described with reference to certain preferred embodiments, those skilled in the art will appreciate that various modifications, changes, omissions and substitutions can be made without departing from the spirit of the invention. It is intended, therefore, that the invention be limited only by the following claims construed as broadly as applicable law allows including all proper equivalents thereof.

We claim:

1. A rigid window well structure comprising:

a) a first generally planar side wall;

b) a second generally planar side wall;

c) a generally planar front wall;

d) a first connecting wall;

e) a second connecting wall, wherein the first connecting wall joins the first side wall to the front wall and the second connecting wall joins the second side wall to the front wall, such that each of the walls expose an interior surface and an exterior surface; and f) a step bridged between the interior surfaces of at least two non-parallel walls wherein at least one of the at least two non-parallel walls is generally planar and wherein the step being bridged between the interior surfaces adds rigidity to, and stiffens the structure.

2. The rigid window well structure of claim 1 wherein the step is bridged between the interior surface of the front wall and the interior surface of the first side wall.

3. The rigid window well structure of claim 2 wherein a second step is bridged between the interior surface of the front wall and the interior surface of the first side wall.

4. The rigid window well structure of claim 2 wherein the step is further connected to the interior surface of the first connecting wall.

5. The rigid window well structure of claim 3 wherein the second step is further connected to the interior surface of the second connecting wall.

6. The rigid window well structure of claim 1 wherein each of the connecting walls are planar.

7. The rigid window well structure of claim 1 wherein each of the connecting walls are arcuate, and wherein the inner surface of the walls form a continuous U-shaped surface.

8. The rigid window well structure of claim 1 wherein the walls and the steps are comprised of a high density plastic material.

9. The rigid window well structure of claim 1 wherein the walls and the steps are comprised of a high density polyethylene skin and a linear low density polyethylene core.

10. The rigid window well structure of claim 1 wherein the plastic window well structure comprises a single unitary panel found as a continuous piece.

11. The rigid window well structure of claim 1 wherein the walls and the steps are comprised of a metal material.

12. The rigid window well structure of claim 1 wherein at least one wall is corrugated.

13. The rigid window well structure of claim 3 further comprising at least one additional step bridged between the interior surface of the front wall and the interior surface of the first side wall and one additional step bridged between the interior surface of the front wall and the interior surface of the second side wall.

14. The rigid window well structure of claim 13 wherein the first step, the second step, and additional steps are connected to the interior surface of the connecting walls.

15. The rigid window well structure of claim 6 wherein the connecting walls are each configured at from about 120–150° in relation to the interior surface of the front wall and from about 60–120° in relation to the opposing connecting wall.

16. The rigid window well structure of claim 15 wherein the connecting walls are each configured to define an angle of about 135° in relation to the interior surface of the front wall and about 90° in relation to the opposing connecting wall.

17. The rigid window well structure of claim 1 wherein the step connected to the interior surface provides a step cavity on the exterior surface configured for accepting retained earth, thereby providing additional strength to the step.

18. A rigid window well structure comprising:

a) a first generally planar side wall;

b) a second generally planar side wall;

c) a generally planar front wall;

d) a first generally planar connecting wall;

e) a second generally planar connecting wall wherein the first connecting wall joins the first side wall to the front wall and the second connecting wall joins the second side wall to the front wall, and wherein the connecting walls are each configured at from about 120–150° in relation to the interior surface of the front wall and from about 60–120° in relation opposing connecting wall; and f) a step bridged between an interior surface of at least two non-parallel generally planar walls and wherein the step being bridged between the interior surfaces adds rigidity to, and stiffens the structure.

19. The rigid window well structure of claim 18 wherein the walls are comprised of a high density plastic material.

20. The rigid window well structure of claim 18 wherein the walls are comprised of a high density polyethylene skin and a linear low density polyethylene core.

21. The rigid window well structure of claim 18 wherein the window well structure comprises a single continuous piece.

22. The rigid window well structure of claim 18 wherein at least one wall is corrugated.

23. The rigid window well structure of claim 18 wherein the walls are comprised of metal.

24. A rigid window well structure comprising:

a) a first generally planar side wall;

b) a second generally planar side wall;

c) a planar front wall;

d) a first generally planar connecting wall; and e) a second generally planar connecting wall wherein the first connecting wall joins the first side wall to the front wall and the second connecting wall joins the second side wall to the front wall; and wherein the connecting walls are each configured at from about 120–150° in relation to the interior surface of the front wall and from about 60–120° in relation to the opposing connecting wall; and wherein the walls define an interior surface of the structure, an exterior surface of the structure, and at least one step that bridges at least two non-parallel generally planar walls, and wherein the at least one step being bridged between the at least two non-parallel generally planar walls adds rigidity to, and stiffens the structure and wherein the at least one step defines a cavity along the exterior surface.

25. The rigid window well structure of claim 24 wherein the cavity is configured to accept and retain earth such that when the window well structure is in place, all earth within the cavity is retained and is not exposed on the interior surface, thereby adding strength to the step.

26. The rigid window well structure of claim 24 wherein the walls and the steps are comprised of a high density plastic material.

27. The rigid window well structure of claim 24 wherein the walls and the steps are comprised of a high density polyethylene skin and a linear low density polyethylene core.

28. The rigid window well structure of claim 24 wherein the walls and the steps are comprised of metal.

29. The rigid window well structure of claim 24 wherein at least one wall is corrugated.

30. The rigid window well structure of claim 24 wherein the window well structure is one continuous piece.

31. The rigid window well structure of claim 24 having a plurality of steps on the interior surface which define a plurality of corresponding cavities along the exterior surface.

* * * * *